US010131980B2

(12) United States Patent
Kobayashi et al.

(10) Patent No.: US 10,131,980 B2
(45) Date of Patent: Nov. 20, 2018

(54) METHOD OF PRODUCING NI-BASED SUPERALLOY

(71) Applicant: HITACHI METALS, LTD., Tokyo (JP)

(72) Inventors: Shinichi Kobayashi, Yasugi (JP); Tomonori Ueno, Yasugi (JP); Takehiro Ohno, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/561,304

(22) PCT Filed: Mar. 24, 2016

(86) PCT No.: PCT/JP2016/059509

§ 371 (c)(1),
(2) Date: Sep. 25, 2017

(87) PCT Pub. No.: WO2016/158705

PCT Pub. Date: Oct. 6, 2016

(65) Prior Publication Data

US 2018/0100223 A1 Apr. 12, 2018

(30) Foreign Application Priority Data

Mar. 30, 2015 (JP) ..... 2015-068291

(51) Int. Cl.

| | |
|---|---|
| ***C22F 1/10*** | (2006.01) |
| ***B21J 1/06*** | (2006.01) |
| ***B21J 5/00*** | (2006.01) |
| ***C22C 19/05*** | (2006.01) |
| ***B21H 1/06*** | (2006.01) |
| ***C22C 19/00*** | (2006.01) |
| *C22F 1/00* | (2006.01) |

(52) U.S. Cl.

CPC ..... *C22F 1/10* (2013.01); *B21H 1/06* (2013.01); *B21J 1/06* (2013.01); *B21J 5/00* (2013.01); *C22C 19/007* (2013.01); *C22C 19/05* (2013.01); *C22C 19/056* (2013.01); *C22F 1/00* (2013.01)

(58) Field of Classification Search

CPC ..... C22F 1/10

See application file for complete search history.

(56) References Cited

U.S. PATENT DOCUMENTS

| | | | |
|---|---|---|---|
| 5,759,305 | A | 6/1998 | Benz et al. |
| 2008/0260570 | A1 | 10/2008 | Harada et al. |
| 2011/0194971 | A1 | 8/2011 | Harada et al. |
| 2012/0189488 | A1 | 7/2012 | Hasselqvist |
| 2016/0040276 | A1 | 2/2016 | Ishida et al. |

FOREIGN PATENT DOCUMENTS

| | | |
|---|---|---|
| CN | 101072887 | 11/2007 |
| CN | 102312118 | 1/2012 |
| CN | 102414331 | 4/2012 |
| CN | 102433466 | 5/2012 |
| CN | 102443721 | 10/2013 |
| EP | 2 050 830 | 4/2009 |
| JP | 3-174938 | 7/1991 |
| JP | 9-302450 | 11/1997 |
| JP | 2008-69379 | 3/2008 |
| WO | 2006/059805 | 6/2006 |
| WO | 2014/142089 | 9/2014 |

OTHER PUBLICATIONS

Office Action dated Jul. 3, 2018 in Chinese Application No. 201680018626.2, with English translation.

Fahrmann et al., "Effect of Cooling Rate on Gleeble Hot Ductility of Udimet Alloy 720 Billet", Superalloys 2008: 311-316.

International Search Report, dated Jun. 14, 2016 in corresponding International Application No. PCT/JP2016/059509, with English language translation.

*Primary Examiner* — Jessee R Roe

(74) *Attorney, Agent, or Firm* — Wenderoth, Lind & Ponack, L.L.P.

(57) ABSTRACT

A method of producing a Ni-based superalloy is provided. A hot working material is used and consisting of a specific composition and has a solvus temperature of a γ' phase of 1050° C. or more. The method includes: performing heating in a temperature of 980° C. to 1050° C. with an upper limit of −30° C. from the solvus temperature of the γ' phase, for 10 hours or longer; and performing hot working on the material at a working speed of a strain rate of 2.0/second or more in the above temperature range.

4 Claims, 2 Drawing Sheets

METHOD OF PRODUCING NI-BASED SUPERALLOY

TECHNICAL FIELD

The present invention relates to a method of producing a Ni-based superalloy.

BACKGROUND ART

A Ni-based superalloy which includes many alloy elements such as Al and Ti and is a γ' (gamma prime) phase-precipitation strengthened type is used as a heat resistant member for aircraft engines and gas turbines for power generation. The Ni-based superalloy is mainly configured by a γ phase (matrix) which is a Ni solid solution and a γ' phase (precipitate phase) which is an $L1_2$ type intermetallic compound $Ni_3$ (Al, Ti). In order to improve engine efficiency, it is effective that a turbine is operated at an extremely high temperature. For this, it is necessary that a durable temperature of each turbine member is set to be high. In order to increase the durable temperature of a Ni-based superalloy, it is effective that the amount of the γ' phase is increased. Thus, an alloy having a large amount of the precipitated γ' phase is used in a member requiring high strength. In addition, a turbine member used in a rotation component or the like requires high fatigue strength in many cases. In this case, hot working is further performed on a cast structure in a state where an alloy is melted and solidified, and thus recrystallization is accelerated. Then, a recrystallization structure in a state where a grain size of the matrix (base) is homogeneous and fine is obtained, and thus a substance which can endure a practical use environment is obtained for the first time.

From a viewpoint of performing hot working on the Ni-based superalloy up to having a predetermined shape, the amount of the γ' phase is limited. If the amount of the γ' phase which is a strengthening phase is too much, deformation resistance is increased and hot ductility is decreased, and thus susceptibility to cracks of a material in a hot working process is increased. Thus, the additive amount of a component such as Al or Ti, which contributes to strengthening is generally limited in comparison to a cast alloy which is obtained without hot working.

As the representative of a turbine member in which fatigue strength is practically gave weight, a turbine disk, a turbine case, a shaft, and the like are exemplified. All of the members have large or long product dimensions. Thus, in order to produce materials thereof with high efficiency and high yield, it is desirable that hot working is performed by applying high-speed hot working machines which are represented by a high-speed forging machine, a ring rolling mill, and the like, in accordance with a shape of a product. These high-speed hot working machines perform hot working with a small number of times of heating for a short working time in comparison to a free forging press machine which is industrially used as with the high-speed hot working machine. Thus, it is possible to obtain a predetermined shape with high efficiency.

In a case of such a high-speed hot working machine, a predetermined working amount is obtained for a shorter working time. As a result, a strain rate when a material is deformed is increased. Since an increase of the strain rate in hot working causes deformation resistance of the Ni-based superalloy to be increased, hot ductility is significantly decreased. If a high-speed forging machine or a ring rolling mill is used, hot working is performed at a strain rate higher than three times that in a case of using a free forging press machine.

When hot working is performed on a metal material in a high temperature zone, deformation resistance or hot workability varies depending on the size of the strain rate. If the strain rate is high, the deformation resistance tends to be increased and the hot ductility tends to be decreased. This is because, as the strain rate becomes higher, recovery as a thermal activation procedure does not occur and working hardening significantly occurs by high dislocation density during working. Further, in a case where an alloy having a large amount of the γ' phase is worked at a high strain rate, the γ' phase hinders moving of dislocation. Thus, larger working hardening is shown. Therefore, as the amount of the γ' phase becomes more, hot ductility of a superalloy of a γ' phase precipitation type is decreased at a high strain rate.

From such a circumstance, in a case where hot working is performed on an alloy having a large amount of the γ' phase by using a high-speed hot working machine or a ring rolling mill, susceptibility to cracks of a material is higher than that in a case of using a free forging press machine and thus working is difficult. In practice, a superalloy to which a high-speed hot working machine or a ring rolling mill can be applied has limited types in comparison to those of a free forging press.

In a hot working process which is practically forging or rolling, heat is dissipated toward an outside air in contact with the surface of a hot working material or a die or a roll as long as a special heat-retaining mechanism is not provided around the hot working machine. Thus, the surface temperature is decreased along with an increase of a hot working time.

In a case where hot working is performed on the Ni-based superalloy with decreasing the surface temperature, the γ' phase which is sequentially precipitated with the decrease of the temperature prevents moving of dislocation. Hot ductility is significantly decreased in comparison to the decrease of the temperature in a case of steel or the like for a general structure. This is because, if the temperature is decreased in a precipitation temperature zone of the γ' phase, the amount of the precipitatable γ' phase is increased from a thermodynamic viewpoint. The amount of the γ' phase is increased by precipitating the large amount of the γ' phase in the vicinity of the surface with heat dissipation. However, from a viewpoint of a precipitation hardening mechanism, as the amount of the precipitated γ' phase is increased and the size of the γ' phase is reduced, the γ' phase causes the deformation resistance to be increased and causes ductility to be decreased. Further, the dimensions of the γ' phase precipitated during cooling or the amount of the precipitated γ' phase largely depends on a cooling rate. However, the γ' phase in a case where cooling is performed at a rate of the degree of natural cooling in the air, the γ' phase is very fine and the amount of the γ' phase is large.

From such a circumstance, when the Ni-based superalloy which has a large amount of the γ' phase and has high strength is worked without an occurrence of cracks in a material, an advanced hot working technology is generally required. Various efforts, for example, introduction of a transporting facility for ending working for a short time or a heat-retaining mechanism that suppresses the decrease of a temperature of a working material, in addition to selection of a suitable heating temperature are made. However, the type of a Ni-based superalloy on which hot working can be stably performed is limited.

Thus, a viewpoint of material strength of the Ni-based superalloy and a viewpoint of hot workability generally have a trade-off relationship. In particular, in the current situation, a Ni-based superalloy to which a high-speed hot working machine or a ring rolling mill as described above can be applied is limited to an alloy having a small γ' amount. In a case of a Ni-based superalloy which requires good hot workability even though high-temperature strength of a product is slightly impaired, an alloy design as follows is made. That is, considering that Al, Ti, or other strengthening elements are reduced, and thereby the γ' amount is reduced and the γ' solvus temperature is decreased, and a melting point of a crystal grain boundary is not decreased, the alloy design is made such that a γ single phase region in which hot ductility is good in a high temperature zone is widened and hot working is performed in a γ single phase region in which the γ' phase that strongly hinders deformation during hot working is not provided.

If the representative Ni-based superalloy is used as an example, the followings can be described.

As the representative of a γ' phase precipitation strengthened type Ni superalloy which has relatively high strength and excellent hot workability, there is Waspaloy. This alloy has a low γ' solvus temperature and a wide γ single phase region in a high temperature zone. Thus, hot working can be relatively easily performed in the γ single phase region and the hot working process at a high strain rate, as described above, can be performed.

As a Ni-based superalloy having strength higher than Waspaloy (Waspaloy® is a registered trademark of United Technologies Corporation), Udimet720Li (Udimet® is a registered trademark of Special Metals Co., Ltd.) is exemplified. This alloy has the amount of precipitated γ' and the γ' solvus temperature which are higher than that of Waspaloy, and is one of Ni-based superalloys on which performing hot working is most difficult. Since such an alloy has many added elements, a partial melting temperature is low and it is not possible to stably perform hot working in a temperature zone of the γ' solvus temperature or higher. Accordingly, when hot working is performed on this alloy, working is necessarily performed in a coexistence zone of the γ phase and the γ' phase. Hot working by a free forging press machine is possible, but hot working is very difficult because the γ' phase hinders deformation. Therefore, in the current situation, the hot working process of a high strain rate, which uses ring rolling or the like is not actively used.

As a superalloy having strength much higher than Udimet720Li, there is an alloy of high Co and high Ti as disclosed in Patent Document 1. Similar to Udimet720Li, this alloy is an alloy which can be produced by a hot working process in the related art. However, since the amount of precipitated γ' and the γ' solvus temperature are equal to or more than those of Udimet720Li, this alloy is an alloy on which hot working is difficult to the extent which is equal to or more than that for Udimet720Li.

CITATION LIST

Patent Document

Patent Document 1: Pamphlet of International Publication No. WO2006/059805 Non Patent Document Non Patent Document 1: Proceedings of the Eleventh International Symposium on Super Alloys (TMS, 2008) 311-316 pages

SUMMARY OF INVENTION

Problems to be Solved by the Invention

The Ni-based superalloy which has the large γ' amount as described above has high high-temperature strength. For example, in a case of being used as a turbine member, the Ni-based superalloy exhibits excellent performance. In a case of such an alloy, generally, stable hot working is difficult and cracks easily occur in and on a material during working.

As the shape of an alloy which is expected to be used as a turbine member is expected, there is a long round bar or a ring material having a large diameter. In a case where hot working is performed so as to have such a shape, a high-speed forging machine or a ring rolling mill is desirably used from a viewpoint of yield or quality. Since the hot working machine performs working at a high strain rate, hot working on a high-strength alloy having the large γ' amount in the related art is very difficult, and practical application is limited to an alloy having a small γ' amount and low strength.

In Non Patent Document 1, regarding a forged article of Udimet720Li, an experiment result in that hot workability is improved as a cooling rate after the temperature is increased to 1110° C. becomes slower is disclosed. The knowledge of improving hot ductility by such a heat treatment procedure is important, but this test is performed in a test condition of a relatively slow strain rate which is 1/second.

An object of the present invention is to provide a method of producing a Ni-based superalloy which has good hot workability at even a high strain rate.

Means for Solving the Problems

The inventors have examined a producing method for an alloy having various components which can cause achievement of high strength sufficient for being used in an aircraft engine or a gas turbine for power generation, and found the followings. An appropriate heating process is selected and a specific hot working temperature zone is selected so as to cause the γ' phase which is a strengthening phase not to hinder hot working. Thus, hot workability can be largely improved at even a high strain rate.

That is, according to the present invention, there is provided a method of producing a Ni-based superalloy using a hot working material which has a composition consisting of, in mass %, 0.001 to 0.050% of C, 1.0% to 4.0% of Al, 3.0% to 7.0% of Ti, 12% to 18% of Cr, 12% to 30% of Co, 1.5% to 5.5% of Mo, 0.5% to 2.5% of W, 0.001% to 0.050% of B, 0.001% to 0.100% of Zr, 0% to 0.01% of Mg, 0% to 5% of Fe, 0% to 3% of Ta, 0% to 3% of Nb, and the remainder of Ni and inevitable impurities, and in which a solvus temperature of a γ' phase is equal to or higher than 1050° C. The method includes aa preliminary heating step of performing heating in a temperature range that is 980° C. to 1050° C. and has an upper limit set to be −30° C. from the solvus temperature of the γ' phase, for 10 hours or longer, and a hot working step of performing hot working on the hot working material after the preliminary heating step, at a working speed having a strain rate of 2.0/second or more in a temperature range that is 980° C. to 1050° C. and has an upper limit set to be −30° C. from the solvus temperature of the γ' phase.

Advantageous Effects of Invention

According to the present invention, hot working can be stably performed on a high-strength Ni-based alloy which has a large amount of precipitated γ' and on which hot working has been difficult in the related art among Ni-based superalloy used in an aircraft engine, a gas turbine for power generation, or the like, at a high strain rate. As a result, it is possible to cheaply provide Ni-based superalloys having various shapes such as a long shaft and a ring disk, which require working at a high strain rate, with high yield.

EMBODIMENTS FOR CARRYING OUT THE INVENTION

Figure 1:
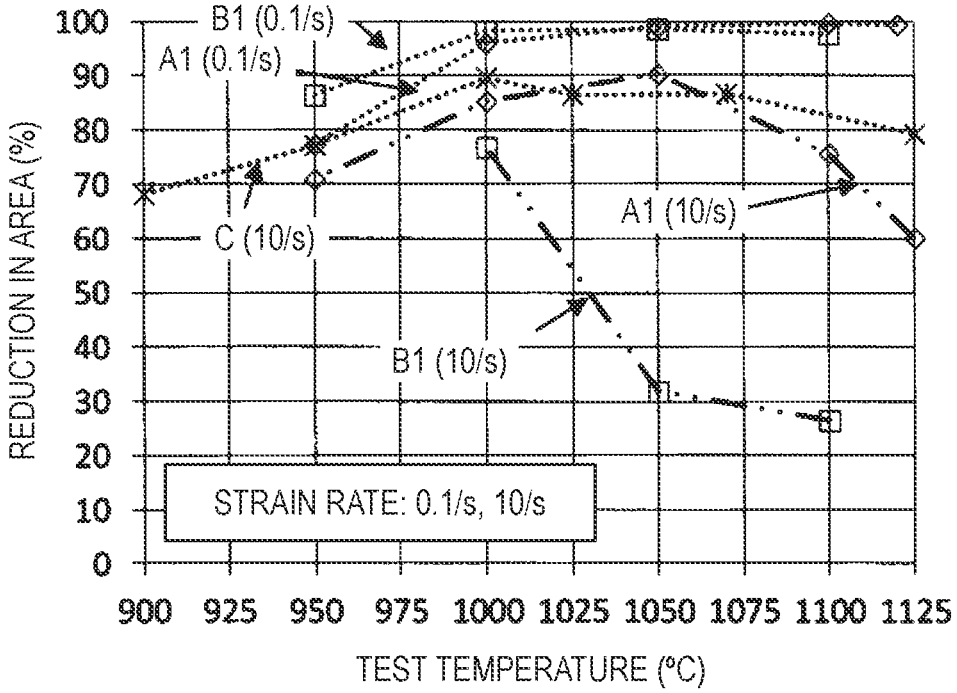
FIG. 1 is a graph illustrating a relationship between reduction in area of a Ni-based superalloy (hot working material) and a test temperature.

Features of the present invention are as follows. In a Ni-based superalloy which has a large amount of a γ' phase and has high strength, heating is performed in a γ/γ' coexistence zone in which the sufficient precipitated amount is expected, for 10 hours or longer, thereby the large amount of the γ' phase is coarsened. Then, hot working is performed in a specific temperature zone. Thus, high-speed hot working which has been difficult in the related art can be performed.

Accordingly, regarding a Ni-based superalloy in which hot working is difficult in the related art, or a long period or large energy is required for hot working, a heating process suitable for a hot working material, a strain rate in hot working, and the like are appropriately managed. Thus, it is possible to obtain a hot working material having high quality, in which many cracks in the surface thereof by decreasing the temperature of the alloy do not occur or coarsening and partial melting of crystal grains by working heat generation do not occur. Hereinafter, a configuration requirement of the present invention will be described.

A Ni-based superalloy defined in the present invention is an alloy in which the amount of the precipitated γ' phase can be equal to or more than 30%. The solvus temperature of the γ' phase is equal to or higher than 1050° C.

The solvus temperature of the γ' phase is determined by alloy components. A Ni-based superalloy which will be described below has a solvus temperature of the γ' phase, which is equal to or higher than 1050° C. The reason is because the present invention in which hot working in a γ/γ' phase coexistence zone is set as a target, acts on an alloy having a higher solvus temperature of the γ' phase, with more efficiency. In a case of an alloy in which the solvus temperature of the γ' phase is lower than 1050° C., volume fraction of the γ' phase which can grow and be coarsened is small even though a preliminary heating treatment is performed. Thus, a sufficient effect is not expected. In addition, an alloy having a low solvus temperature of the γ' phase as described above has a wide γ single phase region together. Since hot working can be performed with relative easiness in the γ single phase region, the present invention is not particularly required.

A reason of limiting an alloy component range defined in the present invention will be described. The following component value is indicated by mass %.

<C: 0.001% to 0.050%>

C has an effect of increasing strength of a grain boundary. This effect is exhibited when the amount of C is equal to or greater than 0.001%. In a case where C is excessively contained, a coarse carbide is formed and thus, strength and hot workability are decreased. Thus, 0.050% is set to be an upper limit. A preferable range for more reliably obtaining the effect of C is 0.005% to 0.040%, a further preferable range is 0.010% to 0.040%, and a more preferable range is 0.010% to 0.030%.

<Cr: 12% to 18%>

Cr is an element that improves oxidation resistance and corrosion resistance. 12% or more of Cr are required for obtaining the effect. If Cr is excessively contained, a brittle phase such as a σ (sigma) phase is formed, and thus strength and hot workability are decreased. Thus, an upper limit is set to 18%. A preferable range for more reliably obtaining the effect of Cr is 13% to 17%, and a more preferable range is 13% to 16%.

<Co: 12% to 30%>

Co can improve stability of a structure and maintain hot workability even if a lot of Ti which is a strengthening element is contained. 12% or more of Co are required for obtaining the effect. As Co is contained more, hot workability is improved. However, if Co is excessive, a harmful phase such as a σ phase or a η (eta) phase is formed, and thus strength and hot workability are decreased. Thus, an upper limit is set to 30%. In both aspects of strength and hot workability, 13% to 28% is a preferable range and 14% to 26% is more preferable range.

<Al: 1.0% to 4.0%>

Al is an essential element that forms a γ' ($Ni_3Al$) phase which is a strengthening phase and improve high-temperature strength. In order to obtain the effect, 1.0% of Al in minimum is required. However, excessive addition causes hot workability to be decreased and causes material defects such as a crack in working to occur. Thus, the amount of Al is limited to a range of 1.0% to 4.0%. A preferable range for more reliably obtaining the effect of Al is 1.5% to 3.0%, a further preferable range is 1.8% to 2.7%, and a more preferable range is 1.9% to 2.6%.

<Ti: 3.0% to 7.0%>

Ti is an essential element that causes the γ' phase to be subjected to solid-solution strengthening and increases high-temperature strength by being substituted at an Al site of the γ' phase. In order to obtain the effect, 3.0% of Al in minimum is required. However, excessive addition causes the γ' phase to become unstable at a high temperature and causes coarsening. In addition, the harmful η phase is formed and hot workability is impaired. Thus, an upper limit of Ti is set to 7.0%. A preferable range for more reliably obtaining the effect of Ti is 3.5% to 6.7%, a further preferable range is 4.0% to 6.5%, and a more preferable range is 4.5% to 6.5%.

<Mo: 1.5% to 5.5%>

Mo has an effect of contributing to solid-solution strengthening of a matrix and improving high-temperature strength. In order to obtain the effect, 1.5% or more of Mo is required. However, if Mo is excessively contained, the brittle phase such as the σ phase is formed, and thus high-temperature strength is impaired. Thus, an upper limit is set to 5.5%. A preferable range for more reliably obtaining the effect of Mo is 2.0% to 3.5%, a further preferable range is 2.0% to 3.2%, and a more preferable range is 2.5% to 3.0%.

<W: 0.5% to 2.5%>

Similar to Mo, W is an element that contributes to solid-solution strengthening of the matrix and, in the present invention, 0.5% or more of W is required. If W is excessively contained, a harmful intermetallic compound phase is formed and high-temperature strength is impaired. Thus, an upper limit of W is set to 2.5%. A preferable range for more reliably obtaining the effect of W is 0.7% to 2.2% and a further preferable range is 1.0% to 2.0%.

B: 0.001% to 0.050%

B is an element that improves grain boundary strength and improves creep strength and ductility. 0.001% of B in minimum is required for obtaining the effect. B has a large effect of decreasing a melting point and workability is hindered if a coarse boride is formed. Thus, a control so as not to exceed 0.050% is needed. A preferable range for more reliably obtaining the effect of B is to 0.005% to 0.040%, a further preferable range is 0.005% to 0.030%, and a more preferable range is 0.005% to 0.020%.

<Zr: 0.001% to 0.100%>

Zr has an effect of improving grain boundary strength similar to B. 0.001% of Zr in minimum are required for obtaining the effect. If Zr is excessively contained, the decrease of the melting point is caused and high-temperature strength and hot workability are hindered. Thus, an upper limit is set to 0.100%. A preferable range for more reliably obtaining the effect of Zr is 0.005% to 0.060% and a further preferable range is 0.010% to 0.050%.

<Mg: 0% to 0.01%>

Mg has an effect of improving hot ductility by fixing S, which is inevitable impurity that is segregated at a grain boundary and hinders hot ductility, as a sulfide. Thus, if necessary, Mg may be added. However, if the large amount of Mg is added, surplus Mg functions as a factor of hindering hot ductility. Thus, an upper limit is set to 0.01%.

<Fe: 0% to 5%>

Fe is a cheap element. If containing Fe is allowed, it is possible to reduce raw material cost of a hot working material. Thus, if necessary, Fe may be added. However, if Fe is excessively added, Fe causes easy precipitation of the σ phase and deterioration of mechanical properties. Thus, an upper limit is set to 5%.

<Ta: 0% to 3%>

Similar to Ti, Ta is an element that causes the γ' phase to be subjected to solid-solution strengthening and increases high-temperature strength by being substituted at an Al site of the γ' phase. Thus, since a portion of Al is substituted with Ta and thus the effect can be obtained, Ta may be added if necessary. Excessive addition of Ta causes the γ' phase to become unstable at a high temperature. In addition, the harmful η phase or δ (delta) phase is formed and hot workability is impaired. Thus, an upper limit of Ta is set to 3%.

<Nb: 0% to 3%>

Similar to Ti or Ta, Nb is an element that causes the γ' phase to be subjected to solid-solution strengthening and increases high-temperature strength by being substituted at an Al site of the γ' phase. Thus, since a portion of Al is substituted with Nb and thus the effect can be obtained, Nb may be added if necessary. Excessive addition of Nb causes the γ' phase to become unstable at a high temperature. In addition, the harmful η phase or δ (delta) phase is formed and hot workability is impaired. Thus, an upper limit of Nb is set to 3%.

Each process in the present invention and a reason of limiting a condition thereof will be described below.

<Preparation of Hot Working Material>

The hot working material which has the above components in the present invention is preferably produced by vacuum melting, similar to other Ni-based superalloys. Thus, it is possible to suppress oxidation of an active element such as Al and Ti and to reduce an inclusion. In order to obtain a higher graded ingot, secondary or tertiary melting such as electroslag remelting and vacuum arc remelting may be performed.

In order to prepare an ingot in which a microstructure is homogenized more, an initial ingot may be produced by a powder metallurgy method.

After the above-described ingot is produced, it is preferable that a hot working material is obtained by press forging and the like in which working is possible at a low strain rate, and a microstructure in which a grain size of a matrix is equal to or more than 5 in ASTM grain size number. The grain size is more preferably equal to or more than 8 of the ASTM grain size number and is further preferably equal to or more than 10 of the ASTM grain size number.

If an example of producing the hot working material will be described, a homogenization heat treatment of holding in a temperature range of 1130 to 1200° C. for at least 2 hours can be performed, thereby precipitates of the γ' phase and the like can be subjected to solid solution. Thus, the material can be softened and then hot working can be easily performed. The working material after the homogenization heat treatment is gradually cooled up to a temperature at which the γ' phase is precipitated, at a cooling rate of 0.03° C./second or less. With the cooling condition, growth of the γ' phase is accelerated. Then, the γ' phase may be caused to grow more in a manner that a heat treatment in which the temperature is increased again to a range of 950 to 1160° C. (but, γ' phase solvus temperature or lower) and the temperature is held for 2 hours or longer is performed, and then cooling is performed at a cooling rate of 0.03° C./second or less. With this process, an average grain diameter of a primary γ' phase can be set to be large, that is, equal to or more than 1 μm, and high hot workability is imparted.

Then, hot working such as hot pressing is performed at a low strain rate by suing the above-described working material. For hot working, a range of 800° C. to 1125° C. is preferable. This is performed in order to cause the γ' phase which is a strengthening phase to be partially subjected to solid solution in a parent phase and to decrease the deformation resistance of the material. Thus, a reheating treatment is performed in a temperature range which is higher than the temperature of hot working and is lower than the γ' phase solvus temperature. With the reheating treatment, recrystallization is caused, distortion is removed, and a coarse cast structure is changed to a fine hot working structure. Therefore, it is possible to improve hot workability. The hot working and the reheating treatment can be repeated plural times.

<Preliminary Heating Process>

A preliminary heating process is performed by using the above-described hot working material, in a temperature range of 980° C. to 1050° C. The temperature range has an upper limit which is set to be −30° C. from the γ' solvus temperature. The temperature range is a temperature range of a coexistence region of the γ/γ' phase. A heating process in this range for at least 10 hours in total is required to be performed. In the preliminary heating process, there is an effect of accelerating growing and coarsening of the γ' phase.

As the γ' phase becomes coarse, plastic deformation occurs easier. Thus, hot ductility is improved.

In the preliminary heating process, for example, if a hot working material having a γ' solvus temperature of about 1160° C. is provided, the temperature range in the preliminary heating process is 980° C. to 1050° C. However, for example, if a hot working material having a γ' solvus temperature of about 1060° C. is provided, the temperature range in the preliminary heating process is a range of 980 to 1030° C., and an upper limit temperature in the preliminary heating process changes in accordance with the γ' solvus temperature.

The reason of defining the upper limit temperature of the preliminary heating process is as follows. From a viewpoint of a thermodynamic equilibrium state, the higher the temperature is, the smaller the volume fraction of the γ' phase which is in equilibrium with the γ phase is. In addition, an effect of improving hot ductility in the next hot working process is not expected. The sufficient volume fraction of the γ' phase is previously in a coarse state, and thus the amount of the precipitated γ' phase with the decrease of the surface temperature in the next hot working at a high strain rate may be set to be minimum.

The reason of setting a lower limit temperature to 980° C. is because it is necessary that a growth rate and a coarsening rate of the γ' phase are secured so as to be equal to or more than certain degrees. In addition, the reason is as follows. As the temperature becomes lower, the volume fraction of the γ' phase in equilibrium with the γ phase is increased, but a diffusion rate of an atom is decreased. Thus, the growth rate and a coarsening rate of the γ' phase are decreased and it is difficult to obtain the effect of improving hot ductility.

<Heating Time and Heating Temperature Pattern>

A heating time for the above-described hot working material is required to be equal to or longer than 10 hours in minimum. An upper limit of the heating time is not particularly limited because the purpose thereof is coarsening of the γ' phase. However, in an aspect of work efficiency, the upper limit thereof is preferably set to be within 60 hours.

The heating time herein is an elapsed time in a temperature range of 980° C. to 1050° C. if a hot working material having a γ' solvus temperature of about 1160° C. is provided. The heating time herein is the total time which includes an isothermal holding time or/and a time to lower a temperature.

Thus, for example, if a hot working material having a γ' solvus temperature of about 1160° C. is provided, holding is performed at a heating temperature of 1100° C. for 2 hours, and then cooling is performed at a cooling rate 10.0° C./hour. In a case where cooling is performed in this state, up to a temperature of lower than 980° C., the heating time in a range of 1050° C. to 980° C. is 7.0 hours. For example, after the hot working material having a γ' solvus temperature of about 1160° C. is held at a heating temperature of 1100° C. for 2 hours, the hot working material is cooled at a cooling rate of 10.0° C./hour. When the temperature reaches 1000° C., cooling is temporarily suspended. In this state, holding is isothermally performed at 1000° C. for 10 hours, and then cooling is performed at a cooling rate of 10.0° C./hour. In a case where cooling is performed up to a temperature of lower than 980° C., an elapsed time (heating time) in the temperature range of 980° C. to 1050° C. is 17 hours.

The reason of the heating time including the temperature lowering time is as follows. The purpose of the heating process is to cause the γ' phase having a predetermined volume fraction or more to be grow and to coarse the γ' phase with high efficiency. In order to obtain the effect, a procedure of isothermal holding is performed. In addition, the effect is also obtained by performing a procedure of lowering the temperature. In a case where the isothermal procedure is performed, firstly, the amount of the precipitated γ' phase is increased by the γ' phase isothermally passing through a precipitation procedure. Then, after the amount of the precipitated γ' phase reaches the thermodynamic equilibrium amount under a state of isothermally holding, a procedure of coarsening is performed.

In a case where the temperature lowering procedure is performed, since the temperature becomes low by the temperature lowering procedure, the γ' phase is precipitated and grows while the thermodynamic equilibrium precipitated amount of the γ' phase is increased. Thus, if a time of 10 hours or longer in total elapses in the temperature range of 980° C. to 1050° C. (in a case where a temperature of the γ' solvus temperature −30° C. is equal to or lower than 1050° C., the temperature of the γ' solvus temperature −30° C. is the upper limit temperature), the γ' phase having a predetermined volume fraction or more is caused to grow and is coarsened with high efficiency.

The reason of the temperature rising time not including a temperature rising time is because solid solution of the γ' phase proceeds in a temperature rising procedure, and thus an effect for the above purpose is not expected.

<Hot Working at High Strain Rate>

Hot working is performed on the hot working material which has passed through the above-described preliminary heating process. The heating temperature applied in hot working is in a temperature range which is 980° C. to 1050° C. and has an upper limit which is set to be −30° C. from the γ' solvus temperature. The temperature range is the temperature range of the coexistence region of the γ/γ' phase. It is necessary that hot working is performed at a working speed which is equal to or more than at least the strain rate of 2.0/second. The strain rate herein is a nominal strain rate for working per one time.

Similar to the above descriptions, regarding the range of the heating temperature in hot working, for example, if a hot working material having a γ' solvus temperature of about 1160° C. is provided, the temperature range in hot working is 980° C. to 1050° C. However, for example, if a hot working material having a γ' solvus temperature of about 1060° C. is provided, the temperature range in hot working is a range of 980 to 1030° C., and an upper limit temperature in hot working changes in accordance with the γ' solvus temperature.

In a case where the heating temperature is higher than 1050° C. as the upper limit (in a case where the temperature of the γ' solvus temperature −30° C. is equal to or lower than 1050° C., the temperature of the γ' solvus temperature −30° C. is the upper limit temperature), the solid solution amount of the γ' phase having a high heating temperature is increased. In this case, in an initial time of hot working of a high strain rate, there is a probability of showing good hot ductility. However, in practice, in a latter period of the hot working, when the surface temperature of the hot working material is decreased by heat dissipation which occurs by a contact with an outside air and a die, the amount of the γ' phase precipitated at a time of decreasing the material temperature on the surface thereof is increased. Therefore, the hot ductility is significantly decreased with heat dissipation and it is difficult to continue hot working. Thus, it is necessary that the solid solution amount of the γ' phase is reduced and the γ' phase at a time of heat dissipation is caused not to be precipitated, by providing the upper limit in the heating temperature. In the Ni-based superalloy having high strength, a large amount of Al, Ti, or other strengthening elements is included. Thus, a melting point of a crystal grain boundary of the matrix is easily lowered and intragranular strength of the matrix is also strong. Accordingly, relative strength of the crystal grain boundary on a high temperature side is low. Thus, a ductility-less temperature (so-called nil ductility temperature) based on intergranular fracture which occurs on a high temperature side at a time of hot working is low. In particular, in deformation of a high strain rate, a result of high a working hardening rate and an increase of the intragranular strength is obtained. Accordingly, grain boundary strength becomes relatively lower and the ductility-less temperature is lowered more. In addition, in the hot working at a high strain rate, the working heat generation amount in the material is higher than that at a time of a low strain rate. Thus, it is very important to select the heating temperature so as cause the temperature of the working material not to reach the ductility-less temperature in the middle of the working. If the upper limit of the heating temperature is suitably managed, coarsening the matrix grain size of the hot working material is suppressed and a fine structure state is maintained. Thus, it is also possible to expect securing of ductility by fine crystal grains.

In a case where the heating temperature is lower than 980° C. as the lower limit, since the heating temperature is low, the deformation resistance of the matrix is increased and the hot ductility is decreased. In addition, since the amount of the γ' phase is also large, the deformation resistance is increased. An excessive increase of the deformation resistance causes a load applied to the hot working machine to be increased and working is difficult. Accordingly, the lower limit temperature is set to 980° C.

The heating time is preferably set to be equal to or longer than 30 minutes from a viewpoint of reducing residual stress or suitably adjusting the solid solution amount of the γ' phase. From a viewpoint of work efficiency, the heating time is preferably set to be within 10 hours. Regarding a temperature pattern during heating, the temperature is caused not to be higher than 1050° C. If the temperature is higher than 1050° C., the γ' phase which has grown and been coarsened in the preliminary heating process is subjected to dissolution. Thus, the effect of improving the hot ductility is lost.

The reason of setting the strain rate to be equal to or more than 2.0/second is because, for example, the strain rate corresponds to a strain rate in a case where hot working of a high strain rate, such as a ring mill is performed. As hot working of a higher strain rate is performed, superiority of the present invention to the method in the related art is increased. Thus, the upper limit is not particularly limited. The strain rate is equal to or more than 2.0/second, preferably equal to or more than 4.0/second, and more preferably equal to or more than 8.0/second.

EXAMPLES

Example 1

In order to confirm the effect of the present invention by using a Ni-based superalloy which is an alloy having a high γ' amount, two hot working materials A and B were prepared. As a comparative example, a hot working material C of an alloy having a low γ' amount, which was out of targets of the present invention was prepared. The hot working material A is a Ni-based superalloy corresponding to Udimet720Li. The hot working material B is a Ni-based superalloy corresponding to one disclosed in Patent Document 1. The alloy of the hot working material A has a γ' solvus temperature of about 1155° C. and a γ' precipitated amount of about 45%. The alloy of the hot working material B has a γ' solvus temperature of about 1170° C. and a γ' precipitated amount of about 50%. The hot working material C is a Ni-based superalloy corresponding to Waspaloy. The hot working material C has a γ' solvus temperature of about 1040° C. and a γ' precipitated amount of about 25%. Thus, the hot working materials A and B are alloys having a chemical composition on which performing hot working is most difficult. The γ' precipitated amount was calculated by using commercial calculation software JMatPro (Version 8.0.1, product manufactured by Sente Software Ltd.). Here, the γ' precipitated amount is the amount of the γ' phase under an equilibrium state at a temperature of 760° C. which is a general aging treatment temperature as a product. The reason of employing the γ' precipitated amount at this temperature is because the γ' precipitated amount after the general aging treatment has a value which largely influences strength as a product.

The hot working material A is a commercially available billet. As the hot working material C, a billet obtained by performing hot forging on a cylindrical Ni-based superalloy ingot with a conventional method was used. The ingot was produced by using a double melting method of a vacuum induction furnace and vacuum arc remelting method which was an industrial melting method.

The hot working material B is obtained by performing hot forging on a cylindrical Ni-based superalloy ingot. The ingot was produced by using a triple melting method of a vacuum induction furnace and electroslag remelting method and vacuum arc remelting method which was an industrial melting method. The hot working material B was produced as follows. A press machine which can perform working at a low strain rate was used as a hot working machine to be used.

Firstly, as the homogenization heat treatment, after holding and heating were performed at 1180° C. for 30 hours, cooling was performed up to room temperature at a cooling rate of 0.03° C./second. Then, after holding and heating were performed at 1150° C. for 60 hours, a heat treatment in which cooling was performed up to room temperature at a cooling rate of 0.03° C./second was performed, and thereby a working material was obtained. Hot free forging was performed on the hot working material by the press machine.

After upset forging was performed on the hot working material at 1100° C. and a hot working ratio of 1.33, a reheating process in which the temperature was increased to 1150° C. and holding was performed for 5 hours was performed, and thus recrystallization was accelerated. Then, after the reheated hot working material was cooled up to 1100° C. at a cooling rate of 0.03° C./second, a forging work of returning (draw) to a diameter corresponding to 040 mm was performed.

Further, after recrystallization was accelerated by heating the forged hot working material to 1150° C. and holding the material for 5 hours, cooling was performed up to 1100° C. at a cooling rate of 0.03° C./second. Thus, second upset forging of a hot working ratio of 1.33 was performed.

Then, similar to a procedure after the first upset forging, reheating was performed to 1150° C. and holding was performed for 5 hours. Then, after cooling was performed up to 1100° C. at a cooling rate of 0.03° C./second, a second forging work of returning to a diameter corresponding to ϕ40 mm was performed.

Further, after heating was performed to 1150° C. and holding was performed for 5 hours, cooling was performed up to 1100° C. at a cooling rate of 0.03° C./second. In this time, a forging work was performed until the final dimensions were about ϕ290 mm×1600 mmL, thereby a hot forging material (billet) was obtained.

In the above forging process, the number of times of heating the material to 1150° C. is total 4 times. The recrystallization of a microstructure was accelerated by the heating treatment of 1150° C., which had been performed in the forging procedure. As a result, the hot workability maintained a good state. In particular, even in working initial time in which performing working was more difficult, that is, at a stage in which hot working was performed on an ingot having a heterogeneous cast solidification structure, significant surface cracks hardly occurred and hot working proceeded with no internal crack. Thus, it was possible to produce a billet.

The chemical compositions of the hot working materials A, B, and C are shown in Table 1 and Table 2 shows evaluation results of the microstructure.

TABLE 1

(mass %)

| No. | C | Al | Ti | Nb | Ta | Cr | Co | Fe | Mo | W | Mg | B | Zr |
|---|---|---|---|---|---|---|---|---|---|---|---|---|---|
| A | 0.015 | 2.6 | 4.9 | 0.04 | 0.01 | 15.9 | 14.6 | 0.15 | 3.0 | 1.1 | 0.0003 | 0.02 | 0.03 |
| B | 0.014 | 2.3 | 6.3 | <0.01 | <0.01 | 13.5 | 24.0 | 0.40 | 2.9 | 1.2 | 0.0002 | 0.02 | 0.04 |
| C | 0.026 | 1.4 | 3.1 | — | — | 19.5 | 13.5 | 0.63 | 4.3 | — | — | 0.01 | 0.06 |

The remainder is Ni and inevitable impurities.
"—" of the hot working material C indicates non-addition.

TABLE 2

| No | ASTM grain size number |
|---|---|
| A | 11.0 |
| B | 12.0 |
| C | 6.0 |

Regarding the hot working materials A and B, the material was cut out in mechanical working and a portion thereof was subjected to a heating treatment which corresponded to the preliminary heating process. Regarding the hot working materials A and B, materials as comparative examples in which the preliminary heating process was not performed were set to be A1 and B1, respectively. Materials in the examples of the present invention, to which the preliminary heating process was applied were set to be A2, A3, and B2 for each heating condition, respectively. The hot working material C was not subjected to the preliminary heating process.

Table 3 shows the preliminary heating process performed on each of the hot working materials. Regarding the temperature upper limit of the preliminary heating temperature defined in the present invention, the hot working material A (γ' solvus temperature of about 1155° C.) is set to 1050° C., and the hot working material B (γ' solvus temperature of about 1170° C.) is set to 1050° C. A hot working material B2 shown in Table 3 has been subjected to the preliminary heating treatment at two stages. The temperature is lowered at 5° C./hour from heating at the first stage, and cooling is temporarily suspended at a stage at which the temperature reaches 1000° C. Heating at the second stage is performed and isothermal holding is performed at 1000° C. for 2 hours. Then, the temperature is lowered at 108° C./hour. Therefore, a time when the hot working material B2 stays in the temperature range of 980° C. to 1050° C. is the time of the preliminary heating process.

TABLE 3

| No. | Preliminary heating process condition Top: heating temperature and heating time Bottom: cooling rate | Heating elapsed time (h) of 1050° C. to 980° C. | Note |
|---|---|---|---|
| A1 | None | — | Comparative Example |
| A2 | 1100° C. × 20 hours<br>108° C./hour | 0.7 | Comparative Example |
| A3 | 1000° C. × 20 hours<br>108° C./hour | 20.2 | Present invention |
| B1 | None | — | Comparative Example |
| B2 | (1) 1100° C. × 2 hours<br>5° C./hour<br>(2) 1000° C. × 2 hours<br>108° C./hour | 12.2 | Present invention |
| C | None | — | Comparative Example |

A high-speed tensile test was performed on the hot working material after the preliminary heating process. The high-speed tensile test is obtained by simulating the hot working process under an isothermal condition, in a practical large-size member.

The tensile test under the isothermal condition simulates an inside of a large-size member in which temperature decrease hardly occurs during hot working. As test conditions, a test temperature was set to be 900° C. to 1125° C. and a strain rate was set to be 0.1/second and 10/second. The strain rate of 0.1/second simulates a strain rate of general free forging pressing. 10/second simulates high-speed hot working in an application range of the present invention.

Firstly, as measurement data which is out of the application range of the present invention, FIG. 1 illustrates a relationship between test temperatures of the hot working materials A1, B1, and C which are not subjected to the preliminary heating process, and reduction in area.

According to FIG. 1, if the strain rate is 0.1/second and slow, even in a case of not applying the present invention, all of the hot working materials A1 and B1 secure a wide hot-workable temperature zone. Thus, it is implied that hot working is relatively easily performed. On the contrary, if the strain rate is 10/second and high, regarding the hot working materials A1 and B1, it is understood that the hot workability is decreased in comparison to that in the condition of 0.1/second. This is because, in plastic deformation at a high strain rate, working hardening of the matrix significantly proceeds and the presence of the γ' phase accelerates working hardening. In particular, since the hot working material B is a Ni-based superalloy which has strength higher than that of the hot working material A, it is understood that such tendency is strong and the hot-workable temperature zone is hardly provided. The hot working material C shows stable hot workability at a strain rate of 10/second, in a case of both a low temperature zone and a high temperature zone. This is because, since the hot working material C has a small amount of the precipitated γ' phase and has a low solvus temperature of the γ' phase, hindrance of deformation by the γ' phase is hardly received. The reason that reduction in area in the temperature zone of 950° C. to about 1075° C. is equal to each other regardless of that the hot working material B1 has the amount of the precipitated γ' phase, which is more than that of the hot working material C is considered to be a difference in a grain size of the matrix. Since the hot working material B1 has a matrix grain size which is smaller than that of the hot working material C, it is considered that, consequently, the hot working materials B1 and C have levels which are equivalent to each other, from balance with the large amount of the γ' phase.

Figure 2:
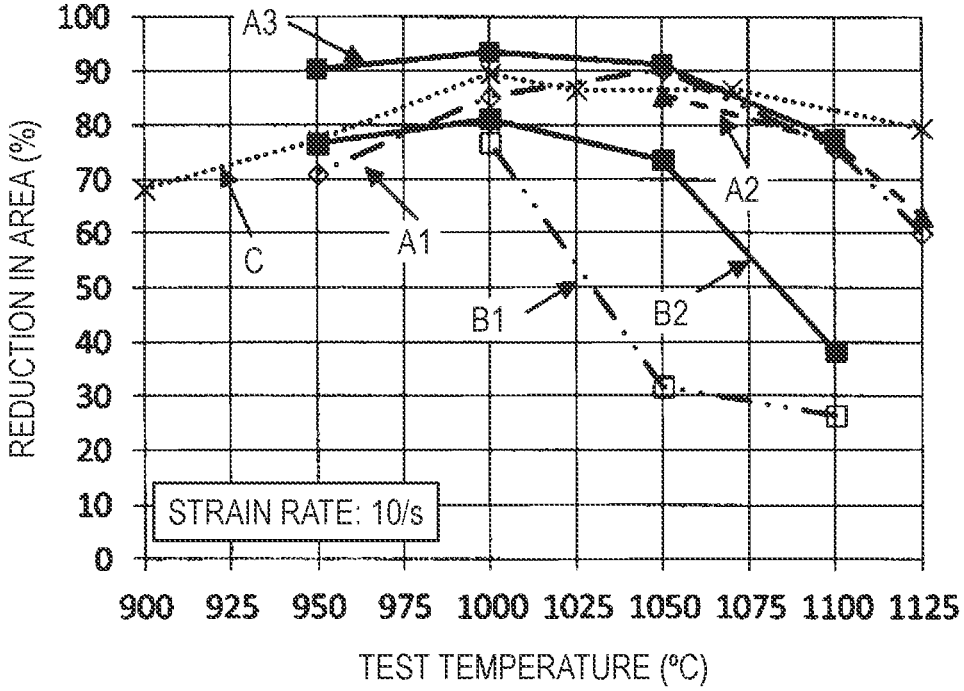
FIG. 2 is a graph illustrating a relationship between reduction in area the Ni-based superalloy (hot working material) to which a high strain rate is applied to and a test temperature.

Next, FIG. 2 illustrates reduction in area in a strain rate of 10/second of the hot working materials A2, A3, and B2 in which the preliminary heating process has been performed, along with the measurement data of the strain rate of 10/second in FIG. 1.

With FIG. 2, the hot working material A2 in which a preliminary heating process which is out of the application range of the present invention has been performed is almost equivalent to the hot working material A1 in which the preliminary heating process is not performed, and the change is not shown.

Regarding the hot working material A3 in which the preliminary heating process in the application range of the present invention has been performed, it is understood that reduction in area is improved on a low temperature side which is equal to or lower than the test temperature of 1000° C., in comparison to the hot working materials A1 and A2.

Next, regarding the hot working material B2 in which the preliminary heating process in the application range of the present invention has been performed, it is understood that reduction in area is totally improved in a wide temperature zone, in comparison to the hot working material B1 in which the preliminary heat treatment is not performed. It is considered that the reason that improvement of reduction in area by the preliminary heating treatment in the hot working material B2 is shown more than that in the hot working material A3 is because the hot working material B is a material which has high strength and has a larger amount of the γ' phase.

Example 2

Then, a high-speed tensile test was performed on the hot working materials A1 to A3, B1, B2, and C. The high-speed tensile test was obtained by simulating hot working with the decrease of the surface temperature in a practical large-size member on the assumption of a work in an actual machine. Here, the decrease of the surface temperature assumes heat dissipation occurring by a contact with an outside air and a die during hot working. In an alloy having a large amount of the precipitated γ' phase, precipitation of the γ' phase significantly occurs with the decrease of the temperature of the material surface. Thus, the hot ductility is also significantly decreased by the decrease of the temperature of the material. It is assumed that performing practical hot working with large heat dissipation is more difficult.

Since such a practical process is simulated, heating and holding were performed in a condition of a temperature of 1000° C. to 1100° C. and a period of 10 to 20 minutes as a first heating process. After a cooling procedure was performed at 200° C./min as the cooling rate which simulated heat dissipation, cooling was suspended at a stage at which the temperature was decreased to a range of −50° C. to −200° C. from the initial heating temperature. After holding was performed for 5 seconds, the high-speed tensile test was performed at a strain rate of 10/second. Firstly, FIG. 3 illustrates test results of the hot working materials A1 to A3 and C.

Figure 3:
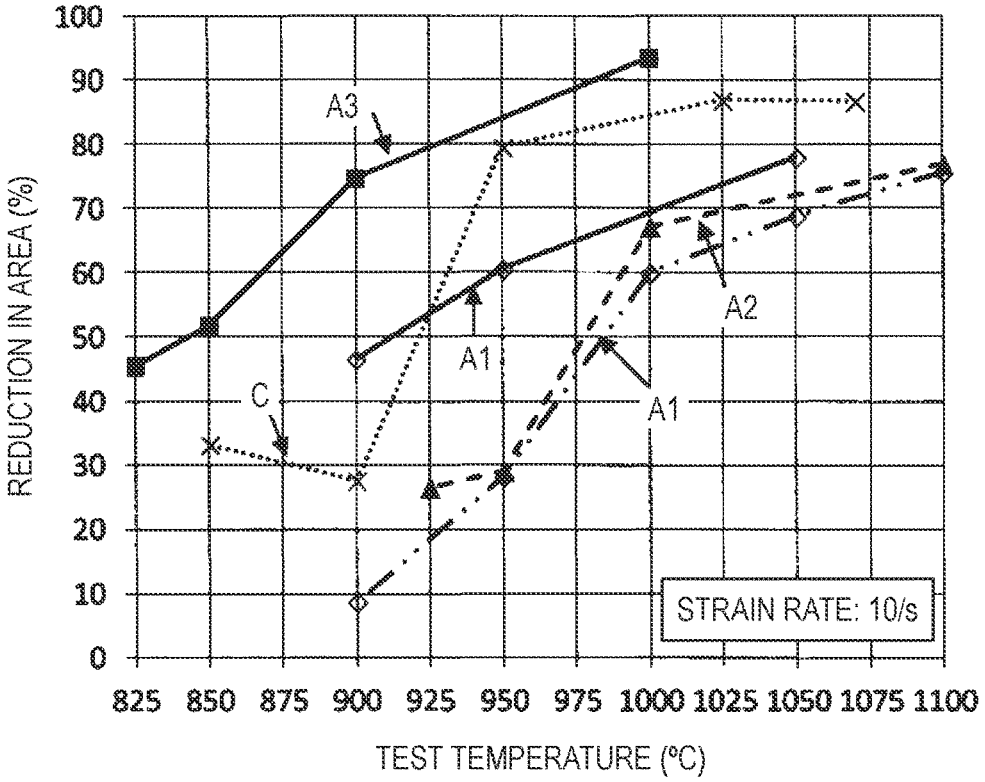
FIG. 3 is a graph which illustrates a change of hot ductility and is obtained by simulating a case where the change of hot ductility follows a decrease of a temperature of the Ni-based superalloy (hot working material).

With FIG. 3, the value of reduction in area of A1 in which the preliminary heating process is not performed is substantially equal to the value of the reduction in area of A2 in which the preliminary heating process which is out of the application range of the present invention is performed. This is because hot ductility is largely deteriorated in comparison to C. It is implied that performing the high-speed hot working is difficult. The followings are understood. A3 in which the preliminary heating process in the application range of the present invention is performed shows high reduction in area in the low temperature zone of −100° C. from the heating temperature. Good hot ductility which is equal to or better than that of C is obtained.

Figure 4:
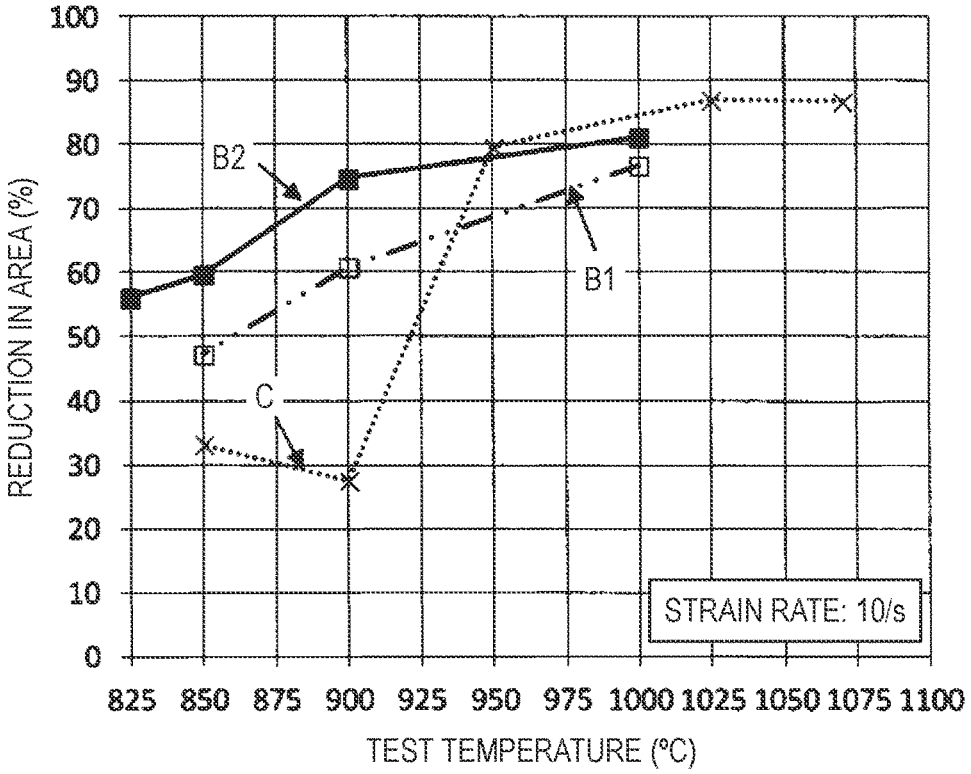
FIG. 4 is a graph which illustrates a change of hot ductility and is obtained by simulating a case where the change of hot ductility follows a decrease of a temperature of the Ni-based superalloy (hot working material).

Next, FIG. 4 illustrates test results of the hot working materials B1, B2, and C.

With FIG. 4, it is understood that B2 in which the preliminary heating process in the application range of the present invention is performed has a reduction in area value which is gradually improved in comparison to that of B1 in which the preliminary heating process is not performed. It is understood that the decrease of ductility occurring by the decrease of the temperature is suppressed small. This means that an influence of crack susceptibility by the decrease of the surface temperature during hot working is suppressed small. It is implied that, even in comparison to C having good hot workability, hot ductility which is equal to or more than that of C is obtained, and a high-strength alloy can be stably subjected to high-speed hot working. In particular, it is understood that, even in a case of a Ni-based superalloy of the working material B having difficult workability, high-speed hot working is possible. From this, in particular, the present invention is efficiently applied to a Ni-based superalloy in which the γ' precipitated amount is more than 45%.

With the above descriptions, it is shown that it is possible to provide a producing method in which hot working at a high strain rate is possible even in the Ni-based superalloy which has a large γ' precipitated amount and has high strength.

In the producing method of the Ni-based superalloy according to the present invention, hot working can be stably performed on a high-strength Ni-based alloy which has a large amount of precipitated γ' and on which hot working has been difficult in the related art among Ni-based superalloy used in an aircraft engine or a gas turbine for power generation, at a high strain rate. As a result, it is possible to cheaply provide Ni-based superalloys having various shapes such as a long shaft and a large-size ring disk, which require hot working at a high strain rate, with high yield.

The invention claimed is:

1. A method of producing a Ni-based superalloy, comprising:

using a hot working material which has a composition consisting of, in mass %, 0.001 to 0.050% of C, 1.0% to 4.0% of Al, 3.0% to 7.0% of Ti, 12% to 18% of Cr, 12% to 30% of Co, 1.5% to 5.5% of Mo, 0.5% to 2.5% of W, 0.001% to 0.050% of B, 0.001% to 0.100% of Zr, 0% to 0.01% of Mg, 0% to 5% of Fe, 0% to 3% of Ta, 0% to 3% of Nb, and the remainder of Ni and inevitable impurities, and in which a solvus temperature of a γ' phase is equal to or higher than 1050° C., a preliminary heating step of performing heating in a temperature range that is 980° C. to 1050° C. and has an upper limit set to be −30° C. from the solvus temperature of the γ' phase, for 10 hours or longer; and a hot working step of performing hot working on the hot working material after the preliminary heating step, at a working speed having a strain rate of 2.0/second or more in a temperature range that is 980° C. to 1050° C. and has an upper limit set to be −30° C. from the solvus temperature of the γ' phase.

2. The method of producing a Ni-based superalloy according to claim 1, wherein in the hot working step, the strain rate of the hot working is 8.0/second or more.

3. The method of producing a Ni-based superalloy according to claim 1, wherein the hot working material has a metal structure in which a grain size of a matrix is equal to or more than 8 in ASTM grain size number.

4. The method of producing a Ni-based superalloy according to claim 1, wherein a γ' precipitated amount of the Ni-based superalloy is more than 45%.

* * * * *